US008148899B2

(12) United States Patent
Maeshima et al.

(10) Patent No.: US 8,148,899 B2
(45) Date of Patent: Apr. 3, 2012

(54) PLASMA DISPLAY PANEL AND METHOD FOR MANUFACTURING THE SAME

(75) Inventors: Satoshi Maeshima, Hyogo (JP); Michiru Kuromiya, Osaka (JP); Seiji Nishitani, Kyoto (JP); Masashi Morita, Osaka (JP)

(73) Assignee: Panasonic Corporation, Osaka (JP)

( * ) Notice: Subject to any disclaimer, the term of this patent is extended or adjusted under 35 U.S.C. 154(b) by 144 days.

(21) Appl. No.: 12/599,342

(22) PCT Filed: Apr. 1, 2009

(86) PCT No.: PCT/JP2009/001530

§ 371 (c)(1),
(2), (4) Date: Nov. 9, 2009

(87) PCT Pub. No.: WO2009/122742

PCT Pub. Date: Oct. 8, 2009

(65) Prior Publication Data

US 2010/0244686 A1 Sep. 30, 2010

(30) Foreign Application Priority Data

Apr. 2, 2008 (JP) ..... 2008-095891

(51) Int. Cl.
*H01J 17/49* (2006.01)
*H01J 9/00* (2006.01)

(52) U.S. Cl. ..... 313/587; 313/582; 313/586; 445/24; 427/126.3; 427/126.1; 427/126.2; 427/376.2

(58) Field of Classification Search ..... 313/582–587; 427/58, 126.1–126.3, 376.2, 68, 376.1; 445/24, 445/25

See application file for complete search history.

(56) References Cited

U.S. PATENT DOCUMENTS 6,911,072 B2 * 6/2005 Kada et al. ..... 106/287.24
(Continued)

FOREIGN PATENT DOCUMENTS

JP 2006-114484 4/2006
(Continued)

OTHER PUBLICATIONS

International Preliminary Report on Patentability issued Dec. 9, 2010 in International (PCT) Application No. PCT/JP2009/001530. International Search Report issued Jul. 7, 2009 in International (PCT) Application No. PCT/JP2009/001530.

*Primary Examiner* — Mariceli Santiago
(74) *Attorney, Agent, or Firm* — Wenderoth, Lind & Ponack, L.L.P.

(57) ABSTRACT

A plasma display of this invention includes a front panel, and this front panel includes a substrate, a plurality of display electrode pairs formed in stripes on the substrate, a dielectric layer formed to cover the display electrode pair and the substrate, a dielectric-protective layer formed to cover the dielectric layer, and fine particles containing a crystal of a metal oxide, the fine particles being dispersed on a surface of the dielectric-protective layer. The display electrode pair is provided with a strip-shaped scanning electrode and a strip-shaped sustaining electrode each having a laminate structure of a transparent electrode and a bus electrode. In the surface of the dielectric-protective layer, a first region corresponding to a region facing the bus electrode of the scanning electrode is smaller than a second region corresponding to a region except the first region, with regard to a cover rate of the surface covered with the fine particles. This configuration allows effective increase of a charge accumulation amount in the first region, and also allows suppression of increase of a discharge start voltage.

9 Claims, 7 Drawing Sheets

U.S. PATENT DOCUMENTS

| | | | | |
|---|---|---|---|---|
| 2003/0096056 | A1* | 5/2003 | Kawamura et al. | 427/66 |
| 2006/0055325 | A1* | 3/2006 | Hirota et al. | 313/587 |
| 2007/0126361 | A1* | 6/2007 | Lee | 313/586 |
| 2007/0170950 | A1* | 7/2007 | Lee | 324/770 |
| 2009/0153019 | A1* | 6/2009 | Lee et al. | 427/372.2 |
| 2010/0141139 | A1* | 6/2010 | Lee et al. | 445/58 |

FOREIGN PATENT DOCUMENTS

| | | |
|---|---|---|
| JP | 2007-311075 | 11/2007 |
| JP | 2008-16214 | 1/2008 |
| JP | 2008-91247 | 4/2008 |
| WO | 2004/049375 | 6/2004 |

* cited by examiner

PLASMA DISPLAY PANEL AND METHOD FOR MANUFACTURING THE SAME

TECHNICAL FIELD

The present invention relates to a plasma display panel in which fine particles each containing a crystal of a metal oxide are dispersed and arranged on a dielectric-protective layer, and a method for manufacturing the same.

BACKGROUND ART

A plasma display capable of realizing a large screen, a reduced thickness and a light weight becomes widely available as a display device for use in a computer monitor, a television receiver, and the like.

As a plasma display panel (hereinafter, referred to as a PDP) of the plasma display, it has been known that there are PDPs of two types, that is, a DC (Direct Current) type and an AC (Alternating Current) type. In particular, the AC type PDP is used typically because it is superior to the DC type PDP in terms of various aspects such as reliability and image quality. Hereinafter, description will be given of a configuration of the conventional AC type PDP.

The conventional PDP has a structure that a discharge space is formed between a front panel and a back panel.

The front panel includes a front substrate, and a plurality of display electrode pairs formed in stripes on one side of the front substrate. The display electrode pair is provided with a strip-shaped scanning electrode and a strip-shaped sustaining electrode arranged in parallel with each other. A strip-shaped shielding layer (a black stripe) is formed between the adjacent display electrode pairs. A dielectric layer is formed on the display electrode pair and the shielding layer to cover the relevant side of the front substrate. A dielectric-protective layer is formed to cover the dielectric layer.

The back panel includes a back glass substrate, a plurality of address electrodes formed in stripes on one side of the back glass substrate, and a dielectric glass layer formed to cover the address electrodes. A plurality of partition walls are formed in stripes on the dielectric glass layer. These partition walls are arranged in parallel with the address electrodes such that each address electrode is located between the adjacent partition walls when being seen in a thickness direction of the back panel. Moreover, the dielectric glass layer and side surfaces of the adjacent partition walls form a groove coated with a red phosphor layer, a green phosphor layer, or a blue phosphor layer.

In the PDP, the front panel and the back panel, which are configured as described above, are disposed such that the respective electrode formation sides are opposed to each other. Further, peripheries of a space between the front and back panels are sealed with a seal member such as frit glass, so that the PDP has a hermetically-closed structure. In this hermetically-closed structure, a hermetically-closed space is formed and is filled with a discharge gas containing neon (Ne), xenon (Xe), and the like at a pressure of 400 Torr to 600 Torr, so that a discharge space is formed. In the PDP, a video signal voltage is selectively applied between the display electrode pair and the address electrode, so that gas discharge occurs at the discharge space. More specifically, address discharge for charge accumulation on a surface of the dielectric-protective layer occurs between the scanning electrode and the address electrode in the discharge space intended to emit light. On the other hand, sustain discharge for generation of ultraviolet rays for use in image formation occurs between the scanning electrode and the sustaining electrode in the discharge space where the electric charge is accumulated. In the PDP, the ultraviolet rays are generated by the gas discharge, and each phosphor layer is excited by the ultraviolet rays to emit visible light. Thus, the PDP can display a color picture.

With regard to the PDP, recently, demand for higher definition grows, and a full HD (High Definition) (1920×1080 pixels: progressive display) PDP capable of realizing low cost, low power consumption, and high brightness is required in the market.

In order to satisfy the requirement, there has been known a method for improving an initial electron emission characteristic (hereinafter, referred to as an electron emission characteristic) of the dielectric-protective layer for causing the address discharge. In order to improve the electron emission characteristic of the dielectric-protective layer, for example, Si (silicon) or Al (aluminum) is added to the dielectric-protective layer made of MgO (magnesium oxide). This method allows increase of a frequency of emitting initial electrons from the dielectric-protective layers, leading to prevention of erroneous address discharge (so-called write defect) that results in flicker of an image.

In the case of improving the electron emission characteristic of the dielectric-protective layer, however, there arises an issue of increase of an attenuation factor that indicates reduction, with time, of a charge accumulation amount as a memory function of the dielectric-protective layer, because of the increase of the frequency of emitting initial electrons from the dielectric-protective layer. The reduction of the charge accumulation amount causes a low potential difference between the scanning electrode and the address electrode, resulting in increase of a voltage required to start the address discharge (hereinafter, referred to as a discharge start voltage). In other words, a trade-off relation is established between the improvement in electron emission characteristic of the dielectric-protective layer and the suppression of increase of the discharge start voltage.

In order to improve this issue, for example, Patent Document 1 (WO 2004/049375 A1) and Patent Document 2 (JP 2008-16214 A) disclose a technique of dispersing and arranging fine particles containing a crystal of a metal oxide on the surface of the dielectric-protective layer.

According to this technique, the dispersed and arranged fine particles improves the electron emission characteristic; therefore, the dielectric-protective layer does not need to improve the electron emission characteristic and is sufficient to only have a function of accumulating the electric charge to suppress the increase of the discharge start voltage. In other words, this technique can improve the issue in such a manner that the dispersed and arranged fine particles and the dielectric-protective layer share a role in improving the electron emission characteristic of the dielectric-protective layer and a role in suppressing the increase of the discharge start voltage.

SUMMARY OF THE INVENTION

Problems to be Solved by the Invention

In the technique described above, however, the dielectric-protective layer is partly covered with the dispersed and arranged fine particles. Consequently, the portion of the dielectric-protective layer, which is covered with the fine particles, fails to accumulate the electric charge and fails to contribute to the suppression of increase of the discharge start voltage. In order to improve the electron emission characteristic, a large number of fine particles are arranged; however, this arrangement results in reduction of an effect of suppressing the increase of the discharge start voltage. Accordingly, the technique described above is susceptible to improvement.

Accordingly, an object of the present invention is to improve the issues described above and to provide a PDP capable of improving an electron emission characteristic and further suppressing increase of a discharge start voltage, and a method for manufacturing the same.

Means for Solving the Problems

In order to achieve the above object, the present invention provides the following configurations.

According to a first aspect of the present invention, there is provided a plasma display panel provided with a discharge space formed by sealing peripheries of a space between a front panel and a back panel opposed to each other, wherein the front panel includes:

a substrate;

a plurality of display electrode pairs formed in stripes on the substrate;

a dielectric layer formed to cover the display electrode pair and the substrate;

a dielectric-protective layer formed to cover the dielectric layer; and fine particles containing a crystal of a metal oxide, the fine particles being dispersed on a surface of the dielectric-protective layer, the display electrode pair is provided with a strip-shaped scanning electrode and a strip-shaped sustaining electrode each having a laminate structure of a transparent electrode and a bus electrode, and in the surface of the dielectric-protective layer, a first region corresponding to a region facing the bus electrode of the scanning electrode is smaller than a second region corresponding to a region except the first region, with regard to a cover rate of the surface of the dielectric-protective layer covered with the fine particles.

According to a second aspect of the present invention, there is provided the plasma display panel as defined in the first aspect, wherein the cover rate in the first region is not more than 90% of the cover rate in the second region.

According to a third aspect of the present invention, there is provided the plasma display panel as defined in the first aspect, wherein in the surface of the dielectric-protective layer, a third region corresponding to a region facing the bus electrode of the scanning electrode and the bus electrode of the sustaining electrode is smaller than a fourth region corresponding to a region except the third region, with regard to the cover rate.

According to a fourth aspect of the present invention, there is provided the plasma display panel as defined in the third aspect, wherein the cover rate in the third region is not more than 90% of the cover rate in the fourth region.

According to a fifth aspect of the present invention, there is provided a method for manufacturing the plasma display panel as defined in the first aspect, comprising: in order to disperse and arrange the fine particles on the surface of the dielectric-protective layer, applying, onto the surface of the dielectric-protective layer, an ink solution including a mixed solvent as a mixture of at least two volatile solvents which are different in viscosity from each other and the fine particles dispersed in the mixed solvent; and drying the applied ink solution in a vacuum to evaporate the mixed solvent.

According to a sixth aspect of the present invention, there is provided the plasma display panel manufacturing method as defined in the fifth aspect, wherein a viscosity of the mixed solvent at 25° C. is not less than 5 mPa·s to not more than 10 mPa·s.

According to a seventh aspect of the present invention, there is provided the plasma display panel manufacturing method as defined in the fifth aspect, wherein a difference in vapor pressure at 25° C. between the two volatile solvents in the mixed solvent is not less than 100 Pa.

According to an eighth aspect of the present invention, there is provided a method for manufacturing the plasma display panel as defined in the first aspect, comprising: in order to disperse and arrange the fine particles on the surface of the dielectric-protective layer, applying, onto the surface of the dielectric-protective layer, an ink solution including a mixed solvent as a mixture of at least two volatile solvents and the fine particles dispersed in the mixed solvent;

heating the scanning electrode to heat a region on the surface of dielectric-protective layer, the region facing the scanning electrode; and drying the applied ink solution to evaporate the mixed solvent.

According to a ninth aspect of the present invention, there is provided the plasma display panel manufacturing method as defined in the eighth aspect, wherein the scanning electrode is heated by voltage application to the scanning electrode.

Effects of the Invention

The plasma display according to the present invention is configured such that the cover rate in the first region facing the bus electrode of the scanning electrode is smaller than the cover rate in the second region except the first region. Herein, the first region is a region where a voltage to be applied in address discharge has a peak value, that is, a region where a potential difference prior to the voltage application must be maintained widely upon the voltage application in the address discharge. Accordingly, in a case where the fine particles are dispersed evenly on the surface of the dielectric-protective layer, a charge accumulation amount in the first region can be effectively increased as compared with a case where the first region and the second region are identical in cover rate to each other. This configuration allows reservation of a satisfactory potential difference for address discharge between the scanning electrode and the address electrode, and also allows further suppression of increase of the discharge start voltage. Moreover, it is unnecessary to change the cover rate in the entire surface of the dielectric-protective layer. Therefore, it is possible to maintain an effect of improving the electron emission characteristic.

The method for manufacturing the plasma display according to the present invention includes applying the ink solution including the mixed solvent as the mixture of at least two volatile solvents which are different in viscosity from each other and the fine particles dispersed in the mixed solvent to the surface of the dielectric-protective layer. In a case where a surface of the ink solution is subjected to shape leveling, even when a surface tension of the ink solution generates toward a protruding portion of the surface of the dielectric-protective layer, the solvent with high viscosity in the mixed solvent suppresses shift of the fine particle toward the protruding portion. Accordingly, the fine particles to be dispersed on the protruding portion located in the region facing the bus electrode of the scanning electrode are reduced in amount, so that the cover rate in the region facing the bus electrode of the scanning electrode becomes smaller than the cover rate in the region except the region. As a result, as described above, it is possible to manufacture a plasma display capable of improving the electron emission characteristic and further suppressing increase of the discharge start voltage.

BRIEF DESCRIPTION OF THE DRAWINGS

These and other aspects and features of the present invention will become clear from the following description taken in conjunction with the preferred embodiments thereof with reference to the accompanying drawings, in which.

MODES FOR CARRYING OUT THE INVENTION

Figure 1:
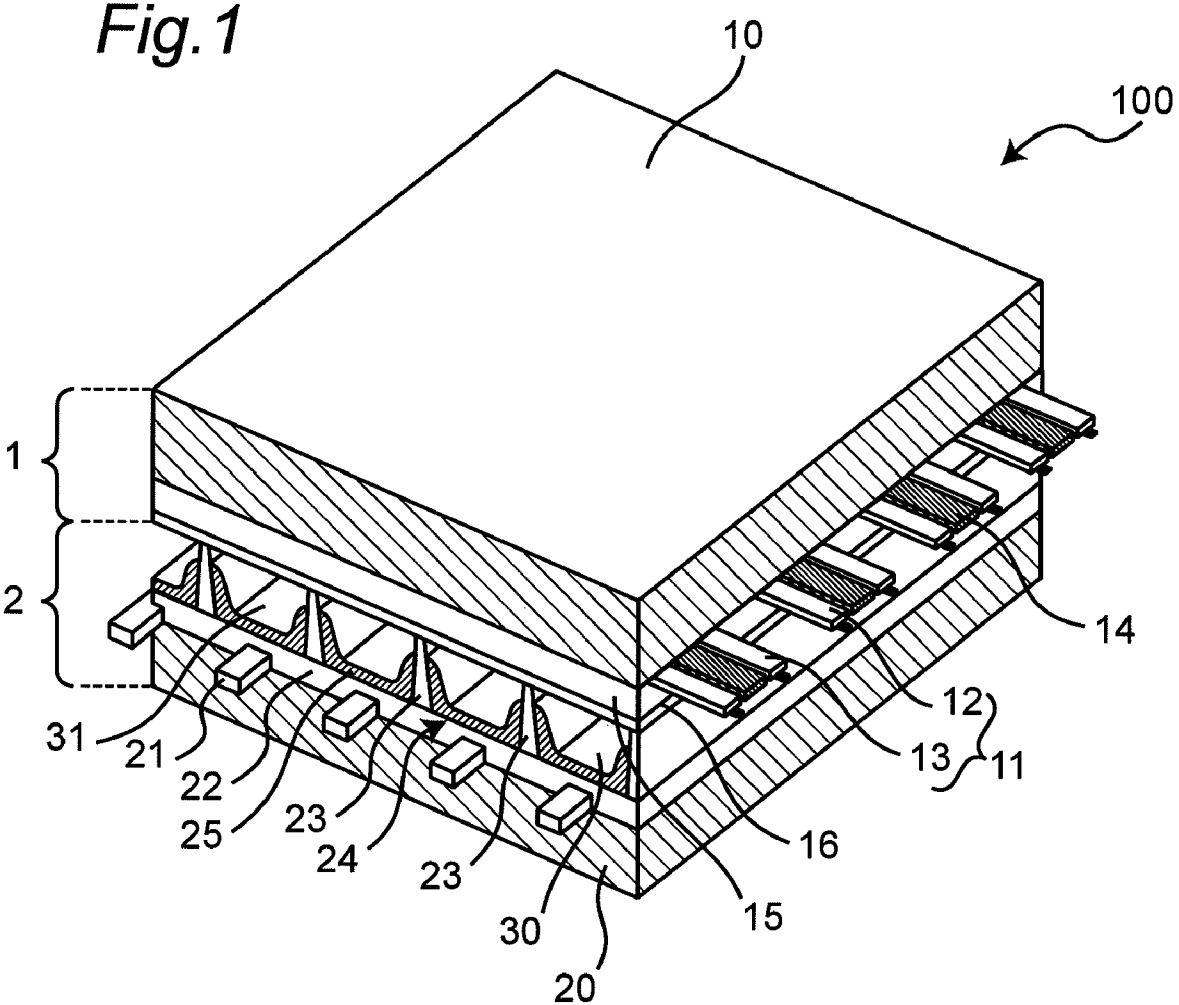
FIG. 1 is a perspective view schematically showing a basic configuration of a PDP according to one embodiment of the present invention.

Before the description of the present invention proceeds, it is to be noted that like parts are designated by like reference numerals throughout the accompanying drawings.

With reference to the drawings, hereinafter, description will be given of a best embodiment of the present invention.

Embodiments

Figure 2:
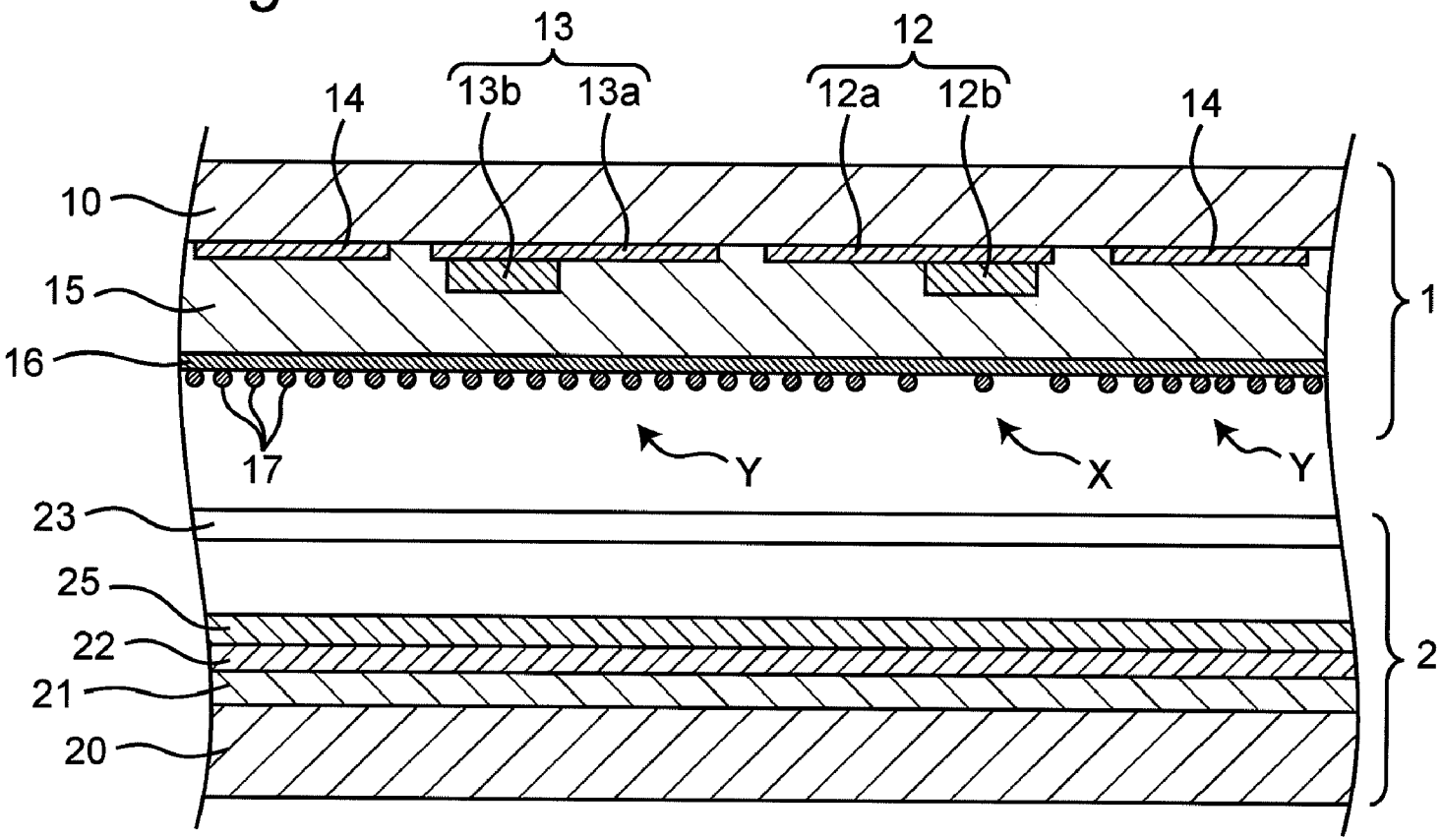
FIG. 2 is a schematic sectional view of the PDP shown in FIG. 1.

With reference to FIGS. 1 and 2, description will be given of a configuration of a PDP 100 according to a first embodiment of the present invention. FIG. 1 is a perspective view schematically showing a basic structure of the PDP 100 according to the embodiment of the present invention. The basic structure of the PDP 100 is similar to that of a typical AC surface discharge type PDP. FIG. 2 is a schematic sectional view of the PDP 100.

In FIG. 1, the PDP 100 includes a front panel 1 for PDPs and a back panel 2 for PDPs opposed to the front panel 1. Herein, a periphery of a space between the front panel 1 and the back panel 2 are surrounded with a seal member (not shown) such as glass frit. Thus, the PDP 100 is hermetically sealed with the seal member, so that a discharge space 30 is formed inside the PDP 100. For example, the discharge space 30 is filled with a discharge gas containing neon (Ne), xenon (Xe) and the like at a pressure of 400 Torr to 600 Torr.

The front panel 1 includes a front substrate 10 made of glass or the like. A plurality of strip-shaped display electrode pairs 11 and a plurality of light shielding layers (black stripes) 14 are formed (in stripes) on a surface of the front substrate 10 in parallel with each other. The display electrode pair 11 is provided with a strip-shaped scanning electrode 12 and a strip-shaped sustaining electrode 13 arranged in parallel with each other. As shown in FIG. 2, each of the scanning electrode 12 and the sustaining electrode 13 has a laminate structure of a transparent electrode (12*a*, 13*a*) that allows visible light to transmit therethrough and a bus electrode (12*b*, 13*b*) that is formed on the transparent electrode (12*a*, 13*a*) to lower a resistance at the electrode. For example, the transparent electrode (12*a*, 13*a*) has a width of about 180 to 200 μm, and the bus electrode (12*b*, 13*b*) has a width of about 60 to 70 μm. Each of the scanning electrode 12 and the sustaining electrode 13 is larger in thickness than the light shielding layer 14.

Moreover, a dielectric layer 15 is formed on the surface of the front substrate 10 to cover the display electrode pair 11 and the light shielding layer 14. The dielectric layer 15 acts as a capacitor when being formed as described above.

A dielectric-protective layer 16 is formed on a surface of the dielectric layer 15 to cover the dielectric layer 15. For example, the dielectric-protective layer 16 is mainly made of MgO and is formed by a thin-film process such as a film formation method, a sputtering method or a CVD method using an EB (Electron Beam) evaporator, a plasma gun evaporator, or the like. The dielectric-protective layer 16 has a function of protecting the scanning electrode 12, the sustaining electrode 13, and the dielectric layer 15 from high-energy ions generated by electric discharge and efficiently emitting secondary electrons to the discharge space 30 to decrease a discharge start voltage.

Fine particle crystals 17 are one example of fine particles containing a crystal of a metal oxide such as MgO and are dispersed on a surface of the dielectric-protective layer 16. As one example, the fine particle crystal 17 is mainly made of MgO generated singly, is higher than the dielectric-protective layer 16 in terms of a ratio of a content of MgO with high crystallinity, and has a function of efficiently emitting secondary electrons to the discharge space 30 as compared with the dielectric-protective layer 16 to promote a start of electric discharge. Preferably, the fine particle crystal 17 is formed such that a mean particle diameter falls within a range of 0.9 μm to 2.0 μum. If the mean particle diameter of the fine particle crystal 17 is less than 0.9 μm, there is a possibility that it is impossible to achieve desired secondary electron emission efficiency because of reduction in ratio of MgO with high crystallinity, resulting in impairment of the function of prompting the start of the electric discharge. On the other hand, if the mean particle diameter of the fine particle crystal 17 is larger than 2.0 μm, there is an increasing probability that when the front panel 1 and the back panel 2 are opposed to each other and then are bonded together, the fine particle crystal 17 comes into contact with a partition wall 23 (to be described later) of the back panel 2 to damage the partition wall 23. This case causes increase of a probability that a defect such as non light emission occurs. Herein, the mean particle diameter denotes a volume cumulative mean diameter (D50).

As shown in FIG. 2 (and FIG. 6), moreover, in the surface of the dielectric-protective layer 16, a region X (a first region) corresponding to a region facing the bus electrode 12*b* of the scanning electrode 12 is smaller than a region Y (a second region) corresponding to a region except the region X, with regard to a cover rate corresponding to a ratio of the surface of the dielectric-protective layer 16 covered with the fine particle crystal 17. This cover rate is described later in detail.

The back substrate 2 includes a back substrate 20 made of glass or the like. A plurality of strip-shaped address electrodes 21 are formed on a surface of the back substrate 20 so as to be orthogonal to the display electrode pair 11 and so as to be parallel with one another.

Moreover, a base dielectric layer 22 is formed on the surface of the back substrate 20 to cover the address electrode 21. A plurality of partition walls 23 are formed on the base dielectric layer 22 in a direction parallel with an extending direction of the address electrode 21 to partition the discharge space 30 for each address electrode 21. The base dielectric layer 22 and side surfaces of the adjacent partition walls 23 form a groove 24 coated with a phosphor layer 25 that emits red light, green light, or blue light by irradiation with ultraviolet rays.

With this configuration, a discharge cell 31 is formed at each intersection where the display electrode pair 11 and the address electrode 21 are orthogonal to each other. In other words, a plurality of discharge cells 31 are arranged in a matrix form. These discharge cells 31 serve as an image formation part of the PDP 100. Moreover, three discharge cells 31, that is, the discharge cell 31 having the red phosphor layer 25, the discharge cell 31 having the green phosphor layer 25, and the discharge cell 31 having the blue phosphor layer 25, which are arranged in an extending direction of the display electrode pair 11, serve as a pixel for color display.

For example, when an external drive circuit applies a drive signal between the scanning electrode 12 and the address electrode 21 and also applies a drive signal between the scanning electrode 12 and the sustaining electrode 13 in succession, gas discharge occurs at each discharge cell 31. More specifically, address discharge for charge accumulation on the surface of the dielectric-protective layer 16 occurs between the scanning electrode 12 and the address electrode 21 in the discharge cell 31 intended to emit light. On the other hand, sustain discharge for generation of ultraviolet rays for use in image formation occurs between the scanning electrode 12 and the sustaining electrode 13 in the discharge cell 31 where the electric charge is accumulated. In the PDP 100, the ultraviolet rays generated in the discharge cell 31 intended to emit light excite the phosphor layer 25 corresponding to the relevant discharge cell 31, so that the phosphor layer 25 emits visible light. Thus, the PDP 100 can display a color picture.

Next, description will be given of the cover rate corresponding to the rate of the surface of the dielectric-protective layer 16 covered with the fine particle crystal 17. Herein, the cover rate indicates a ratio of an area of the surface of the dielectric-protective layer 16 covered with the fine particle crystal 17. For example, this cover rate can be evaluated by a ratio of decrease of a linear transmittance relative to a halogen light source having a maximum light emission wavelength of 550 nm.

Figure 3:
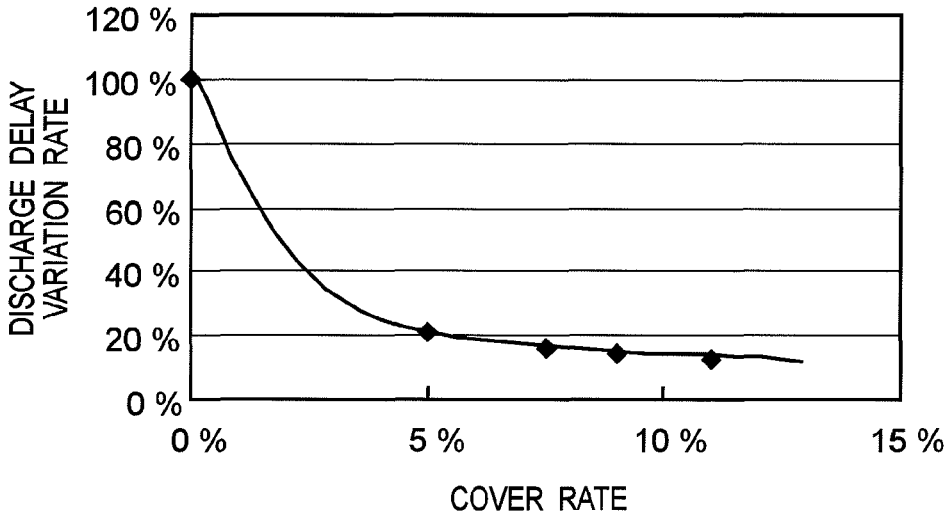
FIG. 3 is a graph showing a relation between a discharge delay variation and a cover rate in an entire surface of a dielectric-protective layer.

FIG. 3 is a graph showing a relation between a discharge delay variation ratio and the cover rate in the entire surface of the dielectric-protective layer 16. Herein, the "discharge delay variation" indicates a variation width in a period of time elapsed from the voltage application between the scanning electrode 12 and the address electrode 21 to the start of the address discharge in each discharge cell 31. This discharge delay variation changes in accordance with the cover rate. The "discharge delay variation ratio" is a percentage of a ratio of a discharge delay variation to a reference discharge delay variation in a case where no fine particle crystal 17 is arranged on the surface of the dielectric-protective layer 16. As the electron emission characteristic of the dielectric-protective layer 16 becomes higher, the discharge delay variation ratio becomes smaller, leading to prevention of erroneous address discharge (so-called write defect) that results in image degradation such as flicker of an image.

As shown in FIG. 3, as the cover rate increases, the discharge delay variation ratio becomes low. For example, when the cover rate is 5%, the discharge delay variation ratio is about 20%. That is, the fine particle crystals 17 are dispersed on 5% of the surface of the discharge protective layer 16, so that the discharge delay variation ratio can be reduced by 80%, leading to considerable improvement in electron emission characteristic of the dielectric-protective layer 16.

Figure 4:
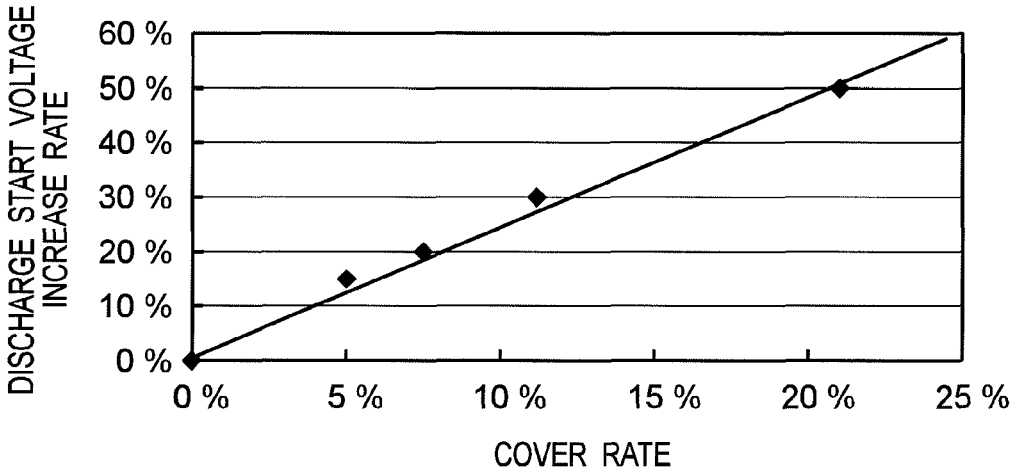
FIG. 4 is a graph showing a relation between a discharge start voltage increase rate and the cover rate in the entire surface of the dielectric-protective layer.

FIG. 4 is a graph showing a relation between a discharge start voltage (Vscn_pd) increase rate and the cover rate in the entire surface of the dielectric-protective layer 16. Herein, the "discharge start voltage" is a voltage required for a start of the address discharge. Moreover, the "discharge start voltage increase rate" is a percentage of a ratio of an amount of increase of a discharge start voltage to a reference discharge start voltage in a case where no fine particle crystal 17 is arranged on the surface of the dielectric-protective layer 16.

As shown in FIG. 4, as the cover rate increases, the discharge start voltage increase rate becomes large. The reason therefor is considered as follows. Since a bared portion of the surface of the dielectric-protective layer 16 becomes small as the cover rate increases, an accumulatable charge amount (hereinafter, referred to as a wall charge amount) decreases. As a result, it is impossible to obtain a wall charge amount sufficient for the address discharge, resulting in an unsatisfactory potential difference between the scanning electrode 12 and the address electrode 21.

As the discharge start voltage is low, the PDP 100 can be driven at a low voltage even in consideration of panel design. Therefore, the PDP 100 can employ a power supply and various electrical components which are small in withstand voltage and capacitance. For example, in a case where an element having a withstand voltage of about 150 V is used as a semiconductor switching element such as a MOSFET for applying a voltage successively to the respective scanning electrodes 12, the discharge start voltage is demanded to suppress to be not more than 100 V in consideration of a variation due to a temperature.

It is apparent from the relations in FIGS. 3 and 4 that it is necessary to increase the cover rate in order to suppress the discharge delay variation (i.e., in order to improve the electron emission characteristic) whereas it is necessary to decrease the cover rate in order to decrease the discharge start voltage increase rate. That is, a trade-off relation is established between the suppression of the discharge delay variation and the decrease of the discharge start voltage increase rate.

In order to suppress the discharge delay variation and to decrease the discharge start voltage increase rate, preferably, the cover rate is set within a predetermined range. Herein, if the cover rate in the entire surface of the dielectric-protective layer 16 is less than 5%, there is a possibility that the effect of suppressing the discharge delay variation is not achieved so much whereas variations in arrangement of fine particle crystals 17 upon mass-production of PDPs 100 become large beyond the assumption. On the other hand, if the cover rate in the entire surface of the dielectric-protective layer 16 is larger than 11%, the discharge start voltage increase rate occasionally becomes not less than about 30% as shown in FIG. 4. In consideration of the variations in characteristic among dielectric-protective layers 16 upon mass-production of PDPs 100, there is a possibility that some PDPs 100 have a discharge start voltage of not less than 100 V. In this case, as described above, an element having a withstand voltage of about 150 V can not be used as a semiconductor switching element for applying a voltage successively to scanning electrodes 12.

For this reason, preferably, the cover rate in the entire surface of the dielectric-protective layer 16 is set within a range of about 5 to 11%.

Figure 5:
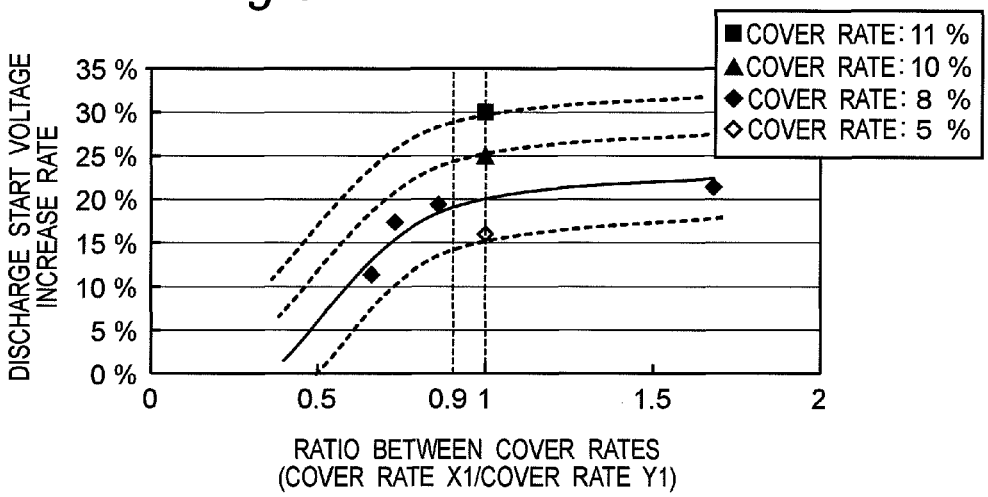
FIG. 5 is a graph showing a relation between the discharge start voltage increase rate and a ratio of a cover rate in a region facing a scanning electrode to a cover rate in a region except the region facing the scanning electrode in the surface of the dielectric-protective layer.

In FIG. 5, a solid curve indicates a relation between the discharge start voltage increase rate and a ratio (X/Y1) of a cover rate X1 in the region X to a cover rate Y1 in the region Y in a case where the cover rate in the entire surface of the dielectric-protective layer 16 is 8%. In a case where the cover rate in the entire surface of the dielectric-protective layer 16 changes, the curve indicating the relation between the ratio (X1/Y1) and the discharge start voltage increase rate establishes the linear relation (the proportional relation) between the discharge start voltage increase rate and the cover rate in the entire surface of the dielectric-protective layer 16 as shown in FIG. 4. Therefore, it is considered that the solid curve laterally moves in an almost vertical direction in FIG. 5. In FIG. 5, doted curves indicate (sequentially from the lowest one) relations between the ratio (X1/Y1) and the discharge start voltage increase rate in cases where the cover rate in the entire surface of the dielectric-protective layer 16 is 5%, 10%, and 11%.

In the case where the cover rate in the entire surface of the dielectric-protective layer 16 is 8%, when the ratio of the cover rate X1 to the cover rate Y1 is 1.0, that is, when the cover rate is uniform in the entire surface of the dielectric-protective layer 16 irrespective of differentiation between the region X and the region Y, the discharge start voltage increase rate is about 20% as shown in FIG. 5. On the other hand, for example, when the ratio of the cover rate X1 to the cover rate Y1 is 0.7, the discharge start voltage increase rate is about 13% as shown in FIG. 5. In other words, when the ratio of the cover rate X1 to the cover rate Y1 decreases from 1.0 to 0.7, the discharge start voltage increase rate can be reduced from about 20% to about 13%.

Figure 6:
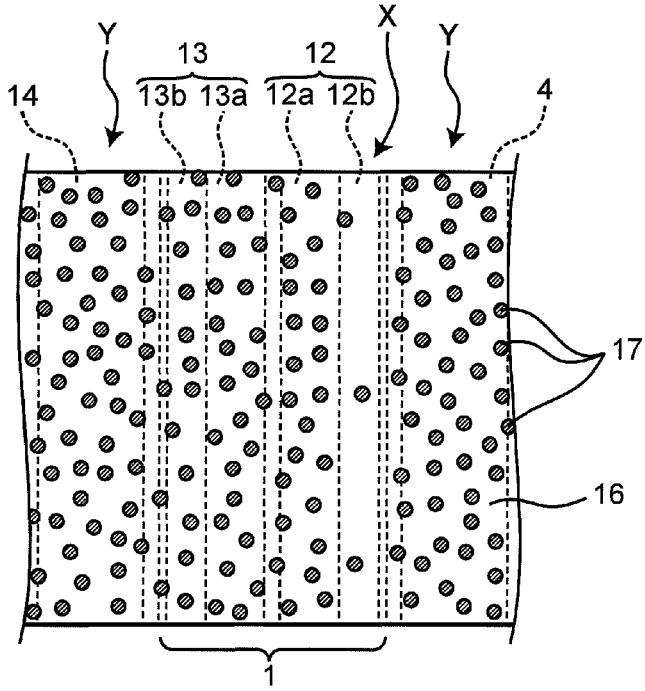
FIG. 6 is a partly enlarged plan view of a front panel of the PDP according to the embodiment of the present invention in a case where the front panel is seen from the dielectric-protective layer.

It is also apparent from FIG. 5 that the discharge start voltage increase rate sharply decreases from a point in time when the ratio of the cover rate X1 to the cover rate Y1 is about 1.0. Accordingly, the discharge start voltage increase rate can be suppressed when the ratio of the cover rate X1 to the cover rate Y1 is smaller than about 1.0, that is, when the cover rate X1 in the region X1 is smaller than the cover rate Y1 in the region Y1. FIG. 6 is an enlarged plan view showing one example that the fine particle crystal 17 is arranged on the surface of the dielectric-protective layer 16 such that the cover rate X1 in the region X1 is smaller than the cover rate Y1 in the region Y1.

Preferably, the cover rate X1 is smaller than the cover rate Y1 as much as possible. However, it is considered that the ratio of the cover rate X1 to the cover rate Y1 varies within a range of about ±0.05, that is, a range of 0.95 to 1.05 because of the variation in manufacture upon mass-production of PDPs 100. In this case, it is also considered that the cover rate X1 is smaller than the cover rate Y1 in some PDPs 100 because of the variation in manufacture; however, the present invention is not intended to include this case. In order to specify that the present invention does not include the variation in manufacture, more preferably, the ratio of the cover rate X1 to the cover rate Y1 is not more than 0.9, that is, the cover rate X1 is not more than 90% of the cover rate Y1. In this case, the cover rate X1 becomes smaller than the cover rate Y1 with certainty irrespective of occurrence of the variation in manufacture. As shown in FIG. 5, moreover, a gradient in a case where the ratio of the cover rate X1 to the cover rate Y1 is not more than 0.9 is steeper than a gradient in a case where the ratio is 0.9 to 1.0. Accordingly, the effect of suppressing the discharge start voltage increase rate is enhanced much more.

In the front panel 1 according to the embodiment of the present invention, the cover rate X1 in the region X facing the bus electrode 12*b* of the scanning electrode 12 is smaller than the cover rate Y1 in the region Y except the region X. Thus, a wall charge amount in the region X becomes larger as compared with a case where the region X is identical in cover rate to the region Y. Herein, the region X is a region where a voltage to be applied in the address discharge has a peak value, that is, a region where a potential difference prior to the voltage application must be maintained widely upon the voltage application in the address discharge. Accordingly, as the wall charge amount in the region X becomes larger, the potential difference for the address discharge between the scanning electrode 12 and the address electrode 21 can be ensured satisfactorily, leading to further suppression of increase of the discharge start voltage. Moreover, it is unnecessary to change the cover rate in the entire surface of the dielectric-protective layer 16; therefore, the effect of improving the electron emission characteristic can be maintained. Accordingly, the front panel 1 according to the embodiment of the present invention allows improvement in electron emission characteristic by dispersion of the fine particle crystal 17 and also allows further suppression of increase of the discharge start voltage.

Figure 7:
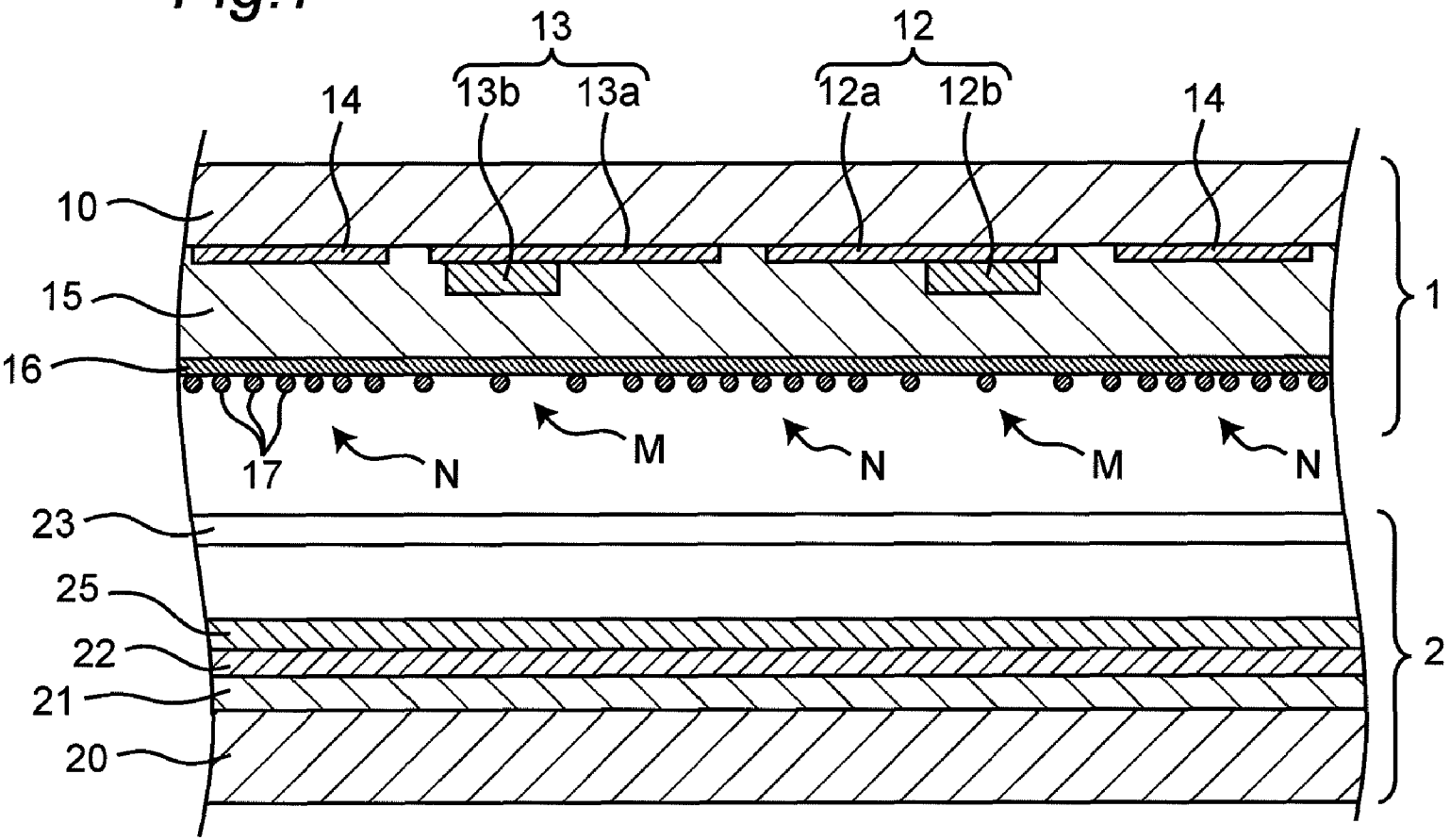
FIG. 7 is a schematic sectional view of a PDP according to a modified embodiment of the present invention.
Figure 8:
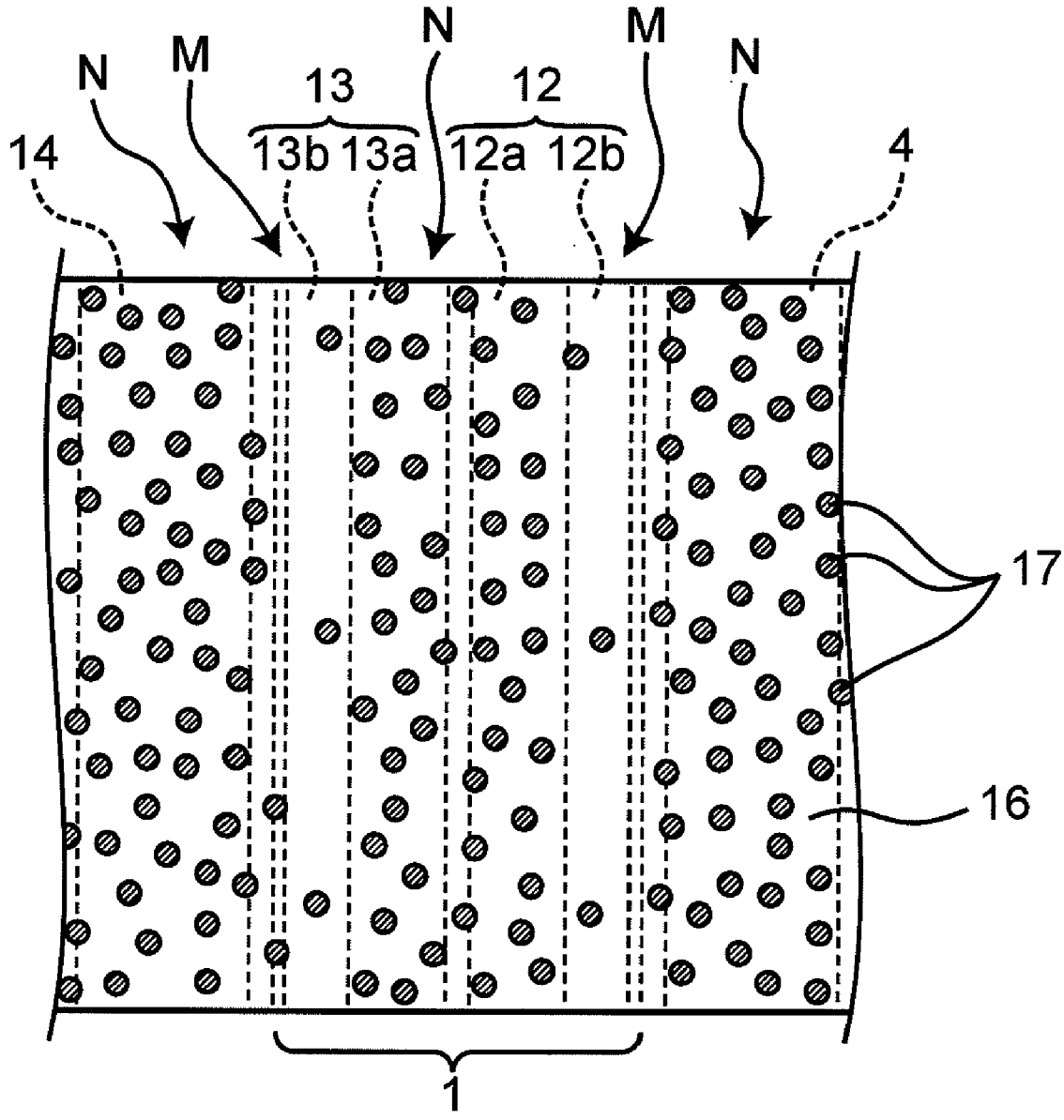
FIG. 8 is a partly enlarged plan view of a front panel of the PDP shown in FIG. 7 in a case where the front panel is seen from a dielectric-protective layer.

In the foregoing configuration, the cover rate X1 in the region X facing the bus electrode 12*b* of the scanning electrode 12 is smaller than the cover rate Y1 in the region Y except the region X; however, the present invention is not limited thereto. In the surface of the dielectric-protective layer 16, for example, a region M (a third region) facing the bus electrode 12*b* of the scanning electrode 12 and the bus electrode 13*b* of the sustaining electrode 13 may be smaller in cover rate than a region N (a third region) except the region M as shown in FIGS. 7 and 8. The region M facing the bus electrodes 12*b* and 13*b* includes a region to which a voltage is applied in the address discharge, and corresponds to a region where a potential difference prior to the voltage application must be maintained widely upon the voltage application in the address discharge. In a case where the amount of fine particle crystals 17 is uniform in the entire surface of the dielectric-protective layer 16, accordingly, when the cover rate in the region M is smaller than that in the region N, a wall charge amount can increase in the region M, leading to further suppression of increase of the discharge start voltage. Moreover, it is unnecessary to change the cover rate in the entire surface of the dielectric-protective layer 16; therefore, the effect of improving the electron emission characteristic can be maintained. Because of reasons similar to those described with regard to the cover rates X1 and Y1, preferably, the cover rate in the region M is not more than 90% of the cover rate in the region N.

Figure 9:
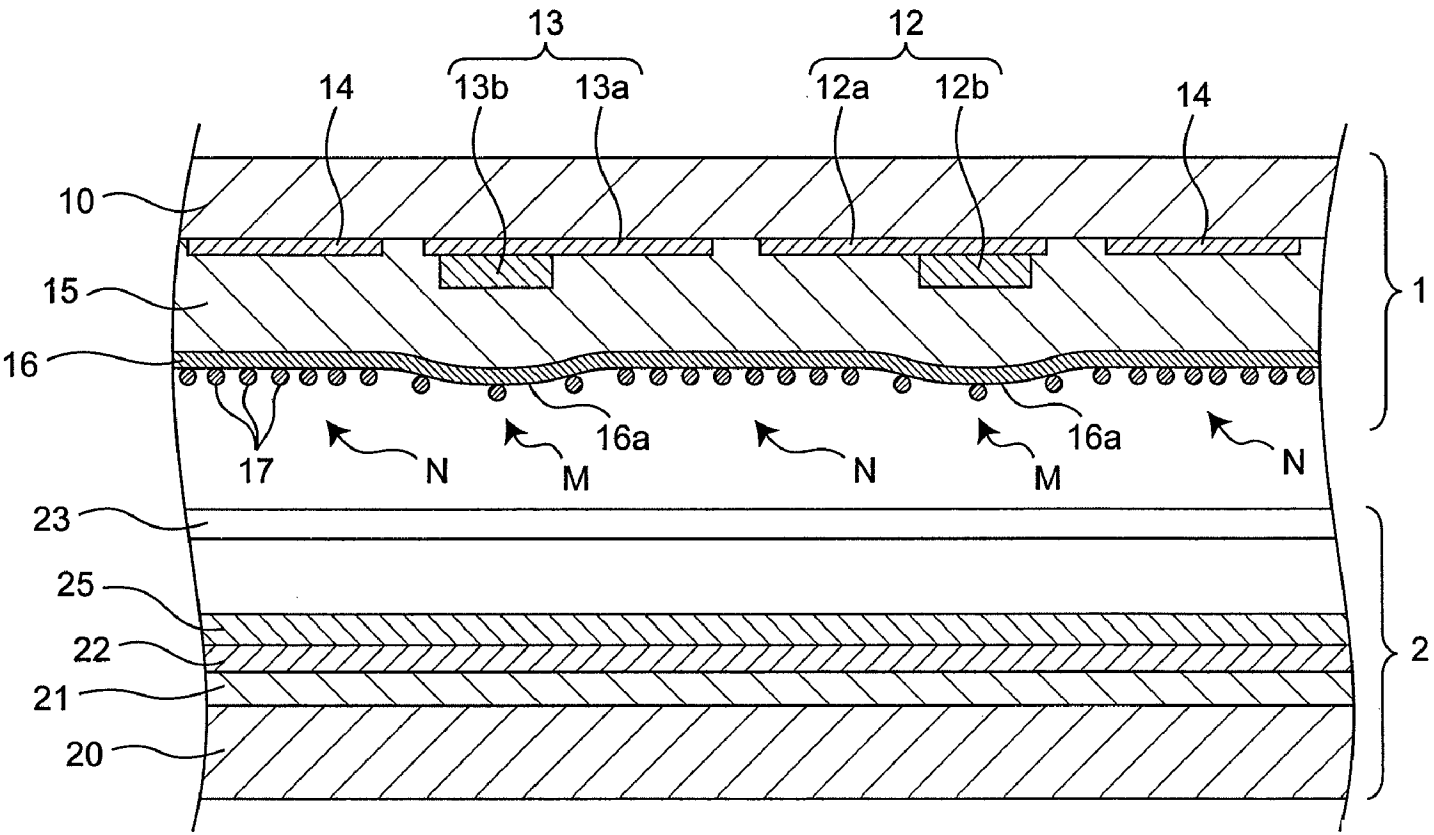
FIG. 9 is a schematic sectional view of a PDP according to a modified embodiment which is different from that shown in FIG. 7.

Next, description will be given of a method for manufacturing the front panel 1 according to the embodiment of the present invention. As one example, description will be given of the method for manufacturing the front panel 1 having the following configuration. That is, portions of the dielectric-protective layer 16 that covers the bus electrodes 12*b* and 13*b* protrude by about 2 μm because of the thicknesses of the respective electrodes 12 and 13 as shown in FIG. 9, and the cover rate in the region M is made smaller than the cover rate in the region N by use of these protruding portions.

First, there are prepared the laminate of the front substrate 10, the display electrode pair 11 and the light shielding layer 14, the dielectric layer 15, and the dielectric-protective layer 16 formed in this order, and an ink solution including a mixture of two volatile solvents (e.g., an alcohol-based solvent) which are different in viscosity and vapor pressure from each other and the fine particle crystal 17 disposed in the mixture. Herein, the portions of the dielectric-protective layer 16 that covers the bus electrodes 12*b* and 13*b* protrude because of the thicknesses of the respective electrodes 12 and 13.

Next, the ink solution is applied onto the surface of the dielectric-protective layer 16 by a slit coater method such that a liquid film thickness becomes not less than 10 μm to not more than 20 μm.

Next, the ink solution is dried in a vacuum such that the mixed solvent is vaporized. Thus, the fine particle crystal 17 is left on the surface of the dielectric-protective layer 16.

In the method for manufacturing the front panel 1, the mixed solvent has a viscosity of not less than 5 mP·s to not more than 10 mP·s at 25° C. Moreover, a difference in vapor pressure between the first solvent and the second solvent constituting the mixed solvent is not less than 100 Pa. The reasons why the viscosity and the difference in vapor pressure of the mixed solvent are set as described above are described later in detail.

In the mixed solvent, moreover, the vapor pressure of the first solvent at 25° C. is not more than 500 Pa in order to stabilize change of a weight due to natural vaporization of the solvent in mass-production whereas the vapor pressure of the second solvent at 25° C. is not more than 10 Pa so as to be dried in the vacuum without being left. Further, the fine particle crystal 17 in the ink solution is dispersed in a weight concentration of 0.4 wt % to 1.0 wt % such that the cover rate is 5% to 12% in the case where the ink solution is applied so as to have the liquid film thickness of not less than 10 μm to not more than 20 μm and then is dried in the vacuum.

Moreover, the slit coater method can be carried out using, for example, a pump that feeds the ink solution with pressure, and a die that includes a liquid sump called a manifold for rendering an ink pressure uniform and a slit for rendering a liquid flow homogeneous. In a state in which a gap distance between the surface of the dielectric-protective layer 16 and a tip of the die is kept within a range of not less than 100 pm to not more than 150 μm, the pump that feeds the ink solution with pressure and the die are activated such that a printing pressure of the pump and an application speed of the die are fixed at 50 mm/s. Thus, the ink solution can be applied to the surface of the dielectric-protective layer 16 such that the liquid film thickness is not less than 10 μm to not more than 20 μm.

Herein, the gap distance set to not less than 100 μm allows prevention of collision of the tip of the die with the surface of the dielectric-protective layer 16 and also allows stable mass-production, in view of surface irregularities of the dielectric-protective layer 16 and mechanical precision of the application operation. In the case where the liquid film thickness of the ink solution is less than 10 μm, it is impossible to render the liquid film thickness of the ink solution uniform if the gap distance is less than 100 μm. In the case where the liquid film thickness of the ink solution on the surface of the dielectric-protective layer 16 is larger than 20 μm, on the other hand, there is a possibility that the uniformity of the liquid film thickness of the ink solution is impaired by uneven temperature due to a roller for use in transport of the laminate to be subjected to the vacuum drying. For these reasons, the liquid film thickness of the ink solution is set to not less than 10 μm to not more than 20 μm.

Moreover, the gap distance is set to not more than 150 μm because the ink solution that includes the mixed solution having the viscosity of not less than 5 mP·a to not more than 10 mP·a at 25° C. is applied so as to have the uniform liquid film thickness. Herein, the application speed of 50 mm/s is fixed in view of productivity.

The vacuum drying can be performed as follows. For example, the front panel 1 before being subjected to the vacuum drying of the ink solution is put in a metal container, and then the metal container is subjected to vacuum degassing using a dry vacuum pump until a degree of vacuum becomes not more than 3 Pa.

Next, description will be given of the viscosity of the mixed solvent.

If the viscosity of the mixed solvent at 25° C. is less than 5 mP·s, there is a possibility that the applied ink solution extends beyond a desired application area and is attached to the seal member such as glass frit with which the front panel 1 and the back panel 2 are hermetically sealed to impair the hermetic property. On the other hand, if the viscosity of the mixed solvent at 25° C. is larger than 10 mP·s, there is a necessity that the gap distance required for rendering the liquid film thickness uniform is set to less than 100 μm in a case where the liquid film thickness is 20 μm which is an upper limit value. As described above, the gap distance which is less than 100 μm makes it difficult to realize stable mass-production. For these reasons, the viscosity of the mixed solution at 25° C. is set to not less than 5 mP·s to not more than 10 mP·s.

Next, description will be given of the reason that the difference in vapor pressure between the first solvent and the second solvent constituting the mixed solvent is not less than 100 Pa.

The main reason that the difference in vapor pressure is not less than 100 Pa is as follows: the cover rate in the region M is made smaller than the cover rate in the region N.

In the front panel 1 according to this embodiment, as described above, the portions of the dielectric-protective layer 16 covering the bus electrode 12*b* of the scanning electrode 12 and the bus electrode 13*b* of the sustaining electrode 13 protrude by about 2 μm when being seen its section as shown in FIG. 9, because of the thicknesses of the respective electrodes 12 and 13. It is assumed herein that a low-viscosity volatile solvent containing the fine particle crystals 17 dispersed therein is applied onto the surface of the dielectric-protective layer 16. In such a case, when a liquid film surface is subjected to shape leveling by the gravity, a surface tension of the solvent generates by the surface irregularities of the dielectric-protective layer 16 toward the protruding portions 16*a*. Thus, the fine particle crystals 17 dispersed in the solvent shift toward the protruding portions 16*a*. Consequently, the cover rate in the region M facing the bus electrode 12*b* of the scanning electrode 12 and the bus electrode 13*b* of the sustaining electrode 13 becomes larger than the cover rate in the region N except the region M.

In contrast to this, according to this embodiment, the ink solution including the mixed solvent and the fine particle crystal 17 dispersed in the mixed solvent is applied onto the surface of the dielectric-protective layer 16. As in the foregoing case, when the surface of the ink solution is subjected to shape leveling, the surface tension of the ink solution generates toward the protruding portions 16*a*. However, the viscosity of the first high-viscosity solvent constituting the mixed solvent suppresses the shift of the fine particle crystals 17. In the vacuum drying, further, the solvent having the higher vapor pressure is dried first in the mixed solvent, leading to increase of a ratio of the solvent having the lower vapor pressure in the mixed solvent. In a typical solvent, as a vapor pressure is lower, a viscosity is higher. Therefore, when the ratio of the solvent having the low vapor pressure increases, the viscosity of the mixed solvent increases. Accordingly, it is possible to further enhance the effect of suppressing the shift of the fine particle crystal 17. Herein, it is possible to further enhance the effect of suppressing the shift of the fine particle crystal 17 when the difference in vapor pressure is not less than 100 Pa.

After the leveling, the liquid film thickness of the ink solution at the protruding portion 16*a* is smaller than that at a recessed portion except the protruding portion 16*a*. With regard to the fine particle crystals 17 left on the surface of the dielectric-protective layer 16 after being subjected to the vacuum drying, therefore, the amount of the fine particle crystals 17 at the protruding portion 16*a* is smaller than that at the recessed portion. Thus, the cover rate in the region M becomes smaller than the cover rate in the region N.

By the method for manufacturing the front panel 1 according to this embodiment, the cover rate in the region M can be made smaller than the cover rate in the region N at low cost. Moreover, the fine particle crystal 17 is arranged on the surface of the dielectric-protective layer 16 by the evaporation of the volatile solvent, and therefore can be prevented from being flocculated and unevenly distributed.

It is to be noted that the present invention is not limited to the foregoing manufacturing method, and may be modified in any other various forms. For example, the arrangement of the fine particle crystal 17 according to this embodiment can also be realized in such a manner that, by use of a screen printing method, a high-viscosity paste having the fine particle crystals 17 dispersed therein is applied onto the surface of the dielectric-protective layer 16, is dried, and then is baked.

When a voltage is applied to the scanning electrode 12 before the drying, electrical resistance heat generates to increase a temperature at the region X facing the bus electrode 12*b* of the scanning electrode 12, leading to reduction of the surface tension of the liquid film in the vicinity of the region X. Thus, a surface tension generates from the liquid film in the vicinity of the region X toward the region Y, so that the fine particle crystal 17 on the region X shifts to the region Y. Thus, it is possible to realize the arrangement of the fine particle crystal 17 according to this embodiment.

In the foregoing description, the temperature at the region X is increased by the voltage application to the scanning electrode 12. Alternatively, the temperature at the region X may be increased in such a manner that heating means provided additionally applies heat to the scanning electrode 12.

Industrial Applicability

The PDP according to the present invention and the method for manufacturing the same allow improvement in electron emission characteristic and further suppression of increase of a discharge start voltage. Therefore, the PDP according to the present invention is useful as a full high definition PDP for use in a computer monitor, a television receiver, and the like.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2008-95891 filed on Apr. 2, 2008, including specification, claims, drawings, and summary are incorporated herein by reference in its entirety.

The invention claimed is:

1. A plasma display panel comprising:

a front panel;

a back panel opposing the front panel; and a discharge space formed by sealing peripheries of a space between the front panel and the back panel, wherein the front panel includes:

a substrate;

a plurality of display electrode pairs formed in stripes on the substrate;

a dielectric layer formed to cover the plurality of display electrode pairs and the substrate;

a dielectric-protective layer formed to cover the dielectric layer; and fine particles containing a crystal of a metal oxide, the fine particles being dispersed on an entire surface of the dielectric-protective layer, wherein each respective display electrode pair of the plurality of display electrode pairs includes a strip-shaped scanning electrode and a strip-shaped sustaining electrode, such that each of the strip-shaped scanning electrode and the strip-shaped sustaining electrode of each respective display electrode pair has a laminate structure of a transparent electrode and a bus electrode, wherein a cover rate of the entire surface of the dielectric-protective layer being covered with the fine particles is 5% to 11%, and wherein the surface of the dielectric-protective layer includes a first region corresponding to a region facing the bus electrode of the scanning electrode and a second region corresponding to a region except the first region, such that the cover rate in the first region of the surface of the dielectric-protective layer being covered with the fine particles is smaller than the cover rate in the second region of the surface of the dielectric-protective layer being covered with the fine particles.

2. The plasma display panel according to claim 1, wherein the cover rate in the first region is not more than 90% of the cover rate in the second region.

3. The plasma display panel according to claim 1, wherein the surface of the dielectric-protective layer includes a third region corresponding to a region facing the bus electrode of the scanning electrode and the bus electrode of the sustaining electrode and a fourth region corresponding to a region except the third region, such that the cover rate in the third region of the surface of the dielectric-protective layer being covered with the fine particles is smaller than the cover rate of the fourth region of the surface of the dielectric-protective layer being covered with the fine particles.

4. The plasma display panel according to claim 3, wherein the cover rate in the third region is not more than 90% of the cover rate in the fourth region.

5. A method for manufacturing the plasma display panel according to claim 1, comprising: in order to disperse and arrange the fine particles on the surface of the dielectric-protective layer, applying, onto the surface of the dielectric-protective layer, an ink solution including a mixed solvent as a mixture of at least two volatile solvents which are different in viscosity from each other and the fine particles dispersed in the mixed solvent; and drying the applied ink solution in a vacuum to evaporate the mixed solvent.

6. The plasma display panel manufacturing method according to claim 5, wherein a viscosity of the mixed solvent at 25° C. is not less than 5 mPa·s to not more than 10 mPa·s.

7. The plasma display panel manufacturing method according to claim 5, wherein a difference in vapor pressure at 25° C. between the two volatile solvents in the mixed solvent is not less than 100 Pa.

8. A method for manufacturing the plasma display panel according to claim 1, comprising: in order to disperse and arrange the fine particles on the surface of the dielectric-protective layer, applying, onto the surface of the dielectric-protective layer, an ink solution including a mixed solvent as a mixture of at least two volatile solvents and the fine particles dispersed in the mixed solvent;

heating the scanning electrode to heat a region on the surface of dielectric-protective layer, the region facing the scanning electrode; and drying the applied ink solution to evaporate the mixed solvent.

9. The plasma display panel manufacturing method according to claim 8, wherein the scanning electrode is heated by voltage application to the scanning electrode.

* * * * *